US009068788B2

(12) United States Patent
Brown

(10) Patent No.: US 9,068,788 B2
(45) Date of Patent: Jun. 30, 2015

(54) WEAPON STABILIZER / HANGER

(71) Applicant: Jay Brown, Beaverton, MI (US)

(72) Inventor: Jay Brown, Beaverton, MI (US)

( * ) Notice: Subject to any disclaimer, the term of this patent is extended or adjusted under 35 U.S.C. 154(b) by 70 days.

(21) Appl. No.: 14/055,066

(22) Filed: Oct. 16, 2013

(65) Prior Publication Data

US 2015/0101233 A1 Apr. 16, 2015

(51) Int. Cl.
*F41C 27/00* (2006.01)
*F41A 23/02* (2006.01)

(52) U.S. Cl.
CPC ..... *F41A 23/02* (2013.01)

(58) Field of Classification Search
CPC ..... F41A 23/10; F41A 23/06; F41A 23/14; F41A 99/00; F41C 33/001; F41C 27/00; A01M 31/02; A01M 31/00; F16M 13/00; F16M 11/04; F16M 11/10; F16M 13/04; F41B 5/1426; F41B 5/148; G02B 23/16
USPC ..... 42/94; 89/37.04
See application file for complete search history.

(56) References Cited

U.S. PATENT DOCUMENTS

| | | | | |
|---|---|---|---|---|
| 5,806,508 | A * | 9/1998 | Stempien et al. | 124/86 |
| 6,021,984 | A | 2/2000 | Mills | |
| 6,202,236 | B1 | 3/2001 | Price | |
| 6,591,825 | B1 | 7/2003 | Huddleston | |
| 6,694,661 | B1 * | 2/2004 | Langford | 42/94 |
| 6,726,160 | B1 | 4/2004 | Buchanan, Jr. | |
| 6,726,163 | B2 * | 4/2004 | Eppard et al. | 248/219.4 |
| 6,749,170 | B1 | 6/2004 | Rhoads | |
| 7,677,233 | B2 | 3/2010 | Bednar | |
| 8,161,956 | B2 | 4/2012 | Bednar | |
| 8,683,909 | B1 * | 4/2014 | Copus | 89/37.04 |
| 2002/0117353 | A1 * | 8/2002 | Jones | 182/3 |
| 2009/0064560 | A1 * | 3/2009 | Saunders, III | 42/94 |
| 2013/0025178 | A1 * | 1/2013 | Blitch | 42/94 |

OTHER PUBLICATIONS

US 7,958,879, 06/2011, Hoffman, (withdrawn).

* cited by examiner

*Primary Examiner* — Troy Chambers
*Assistant Examiner* — Bridget Cochran

(57) ABSTRACT

A weapon stabilizer that is easily installed at a hunting location for stabilization of a weapon. The Prusik knot forms a loop that depends from the support arm of the weapon stabilizer and suspends the weapon for stable firing. The weapon stabilizer has a multitude of embodiments for ways to affix to trees or poles for use. The mounting bracket can be used and affixed to a tree in a variety of ways and then the weapon stabilizer is attached to the mounting bracket.

16 Claims, 11 Drawing Sheets

WEAPON STABILIZER / HANGER

BACKGROUND OF THE INVENTION

Stabilizer/hangers for weapons are not new to the art. There are many prior art examples of devices that are employed to help stabilize weapons for both practice and in the field hunting. All prior art weapon stabilizers are for resting the weapons weight upon the device. Examples of this can be found in U.S. Pat. No. 8,161,956 entitled, "Crossbow support rod" issued to Bednar on Apr. 24, 2012 that teaches a support rod for stabilizing a crossbow. A weapon such as a crossbow or firearm may have a main beam, a trigger mechanism mounted to the main beam and, a support rod that can be positioned into a first use position and a second stowed position. This device supports the weapon or crossbow from underneath. The present invention supports the weapon or bow in a suspended manor. The main arm of the present invention can be swung to store it out of the way. This support has a greater utility over this prior art device in that it is easily use from the ground or from a tree stand.

Another such device is U.S. Pat. No. 7,667,233 entitled, "Camouflage and support assembly for a crossbow", issued to Hoffman on Jun. 14, 2011. Hoffman teaches a camouflage and support assembly for a crossbow is disclosed. The assembly is comprised of a camouflage having an opening for shooting the arrow through while the hunter is hidden from view, and a clamp for affixing the crossbow' stirrup onto the camouflage. The assembly also comprises a comfortable stance for the hunter to wait for an animal to appear into view, while also allowing the hunter to move the crossbow along with the camouflage as needed to maintain focus on a potential moving target. The present invention has greater utility over this prior art example in that it can be use on the ground as well as from a tree stand. It also teaches that the user can swing the weapon without any impediment from the stabilizer. Hoffman make the same claim, but the stabilizer and screen in Hoffman will take two hands to move the stabilizer and the screen while the present invention gives the user the ability to freely swing at least 180° while maintaining visual contact with the game while swinging the weapon attached to the stabilizer of the present invention.

The present invention has a greater utility than any other prior art examples in that it suspends the weapon for support or stabilization whereas the prior art devices all support the weapon from below. It also allows the user to swing freely on moving prey. It also has dual use as a stabilizer on the ground and from an elevated position. Clearly something the prior art devices cannot do.

THE INVENTION

The present invention is a weapon stabilizer/hanger that comprises a support bracket that has a front and a back. The weapon stabilizer has at least two attachments mounted on the front of the support bracket. Each of the attachment is articulatable in a horizontal plane. The weapon stabilizer/hanger has a support bar that has a back and a front with the support bar is fixedly attached to each of the attachments at the back of the support bar. The attachments are spaced apart a predetermined distance from each other.

The support arm has a first end and a second end and is fixedly attached to the front of the support bar by the first end. One end of a cord is looped around the support arm. The opposite end of the cord has a Prusik knot tied thereon near the opposite end thereof. The opposite end of the cord has a fixed looped terminal end.

DETAILED DESCRIPTION OF THE DRAWINGS

Figure 1:
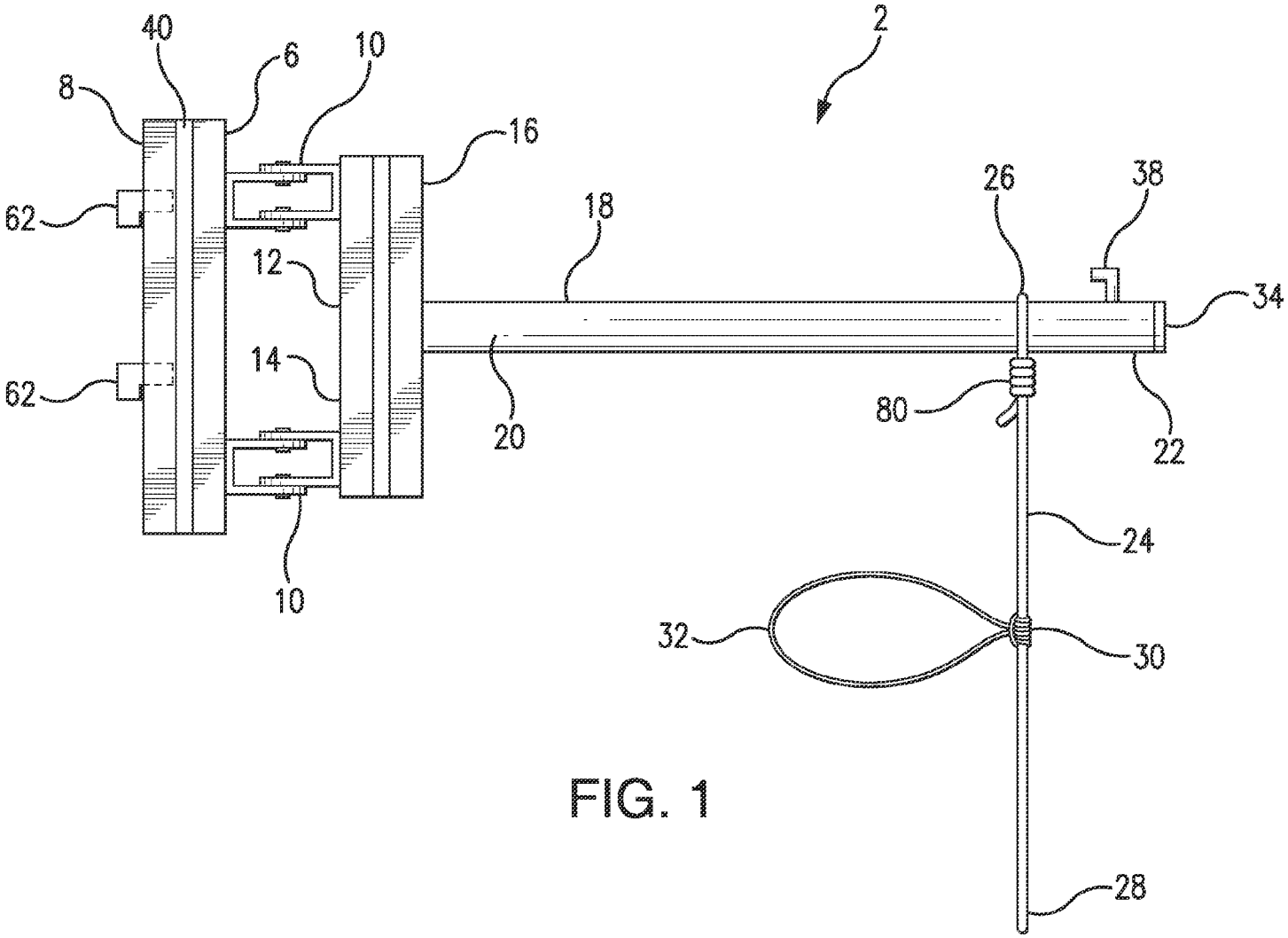
FIG. 1 shows the weapon stabilizer/hanger from the side with the loop.

FIG. 1 shows the weapon stabilizer/hanger 2 from the side with the fixed loop 32. The support bracket 4 has front 6 and a back 8. The front 6 of the support bracket 4 has to hinges or articulatable features 10. The hinges 10 on the back 14 of the support bar 12 connect the support bar 12 to the support bracket 4 in an articulated manner allowing the support bar 12 to swing.

The front 16 of the support bar 12 has the support arm 18 attached thereto. The support arm 18 has a front 20 that connects to the support bar 12. The second end 22 of the support arm 18 has the cord 24 suspended from it. This embodiment has a cord stop 38 to prevent the cord from becoming disengaged with the support arm 18. Also on this embodiment is an end cap 34 that prevents any rough edges from damaging the user or the weapon. The cord 24 depends from the support arm 18. The cord 24 has a first end 26 that has a slip knot 80 that loosely attaches the cord 24 to the support arm 18. Near the second end 28 of the cord 24 is a Prusik knot 30 that forms the loop 32.

Figure 3:
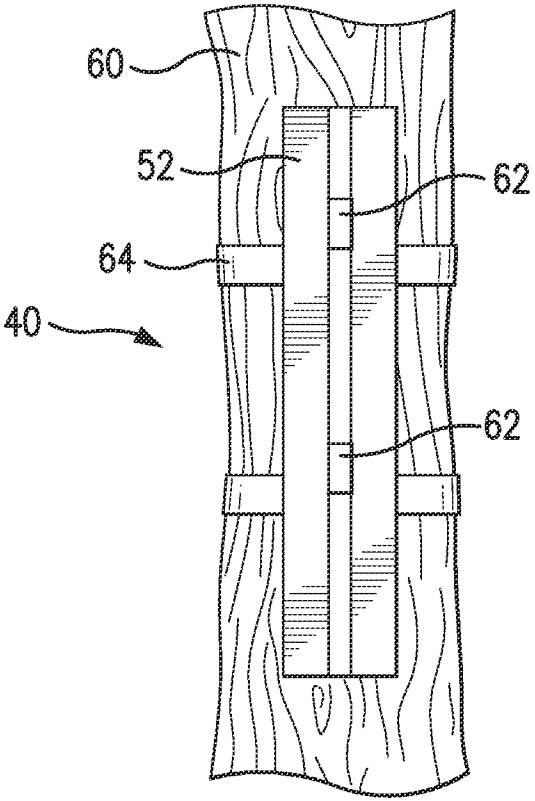
FIG. 3 shows the weapon stabilizer/hanger mounting bracket from the front.

Also shown are the hooks or stops 62 that lock the support bar into the mounting bracket 40 (FIG. 3).

Figure 2:
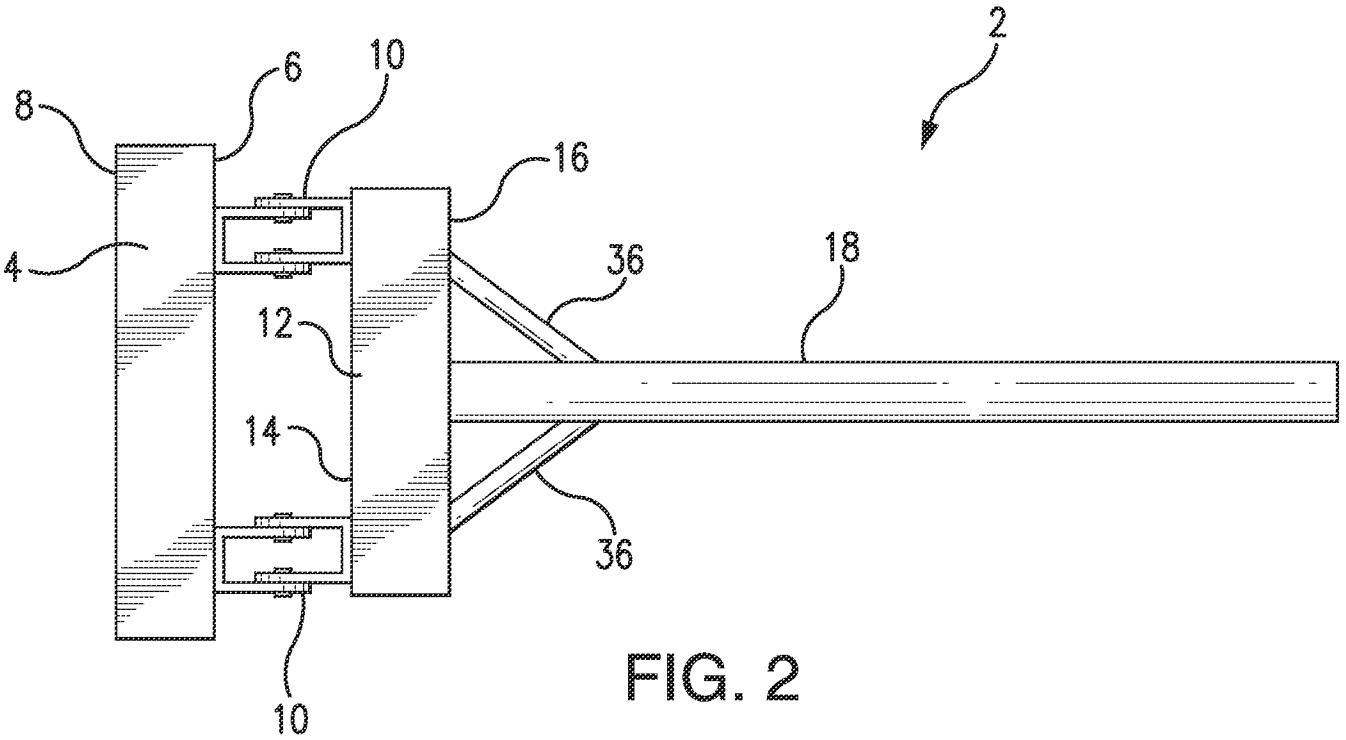
FIG. 2 shows the weapon stabilizer/hanger from the side.

FIG. 2 shows the weapon stabilizer/hanger 2 from the side. This embodiment has support gussets 36 to provide the support arm 18 with a greater level of support while the device is in use. This embodiment also does not include a mounting bracket 40. The device 2 is connected directly to a tree.

FIG. 3 shows the weapon stabilizer/hanger 2 mounting bracket 40 from the front 52. The stabilizer 2 can be attached directly to an object such as a tree 60 or a pole. This embodiment uses a mounting bracket 40 that mounts to the tree 60 or a pole then the stabilizer 2 attaches to the mounting bracket 40. Here the stabilizer 2 has two hooks or stops 62 and the mounting bracket 40 has two stops. When the two pieces are slide together they lock into place and the stabilizer is attached to the mounting bracket 40 which is attached to the tree 60. Here the mounting bracket 40 is attached to the tree 60 via straps 64.

Figure 4:
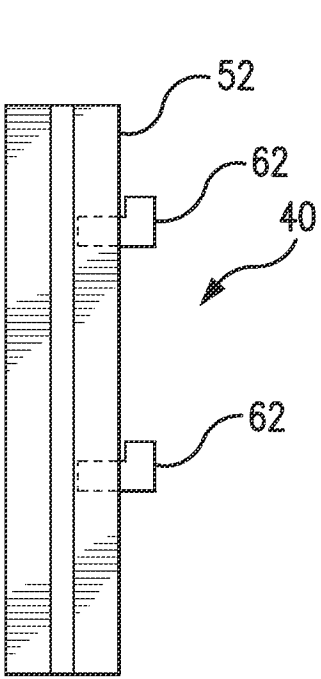
FIG. 4 shows the weapon stabilizer/hanger mounting bracket from the side.

FIG. 4 shows the weapon stabilizer/hanger 2 mounting bracket 40 from the side. This shows how the stabilizer/hanger 2 support bracket 4 will slide and lock on the mounting bracket 40. The hooks or stops 62 are on the front 52 of the mounting bracket 40 and the hooks 62 of the support bracket 4 meshes and lock.

Figure 5:
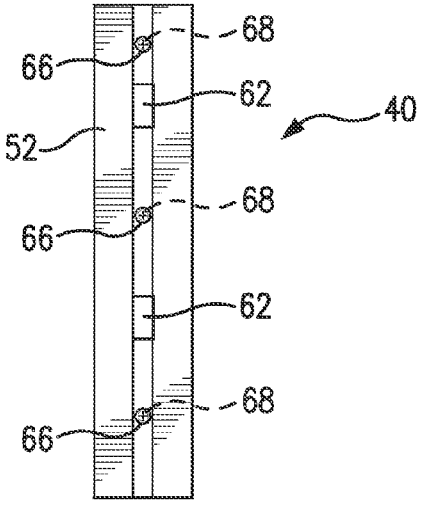
FIG. 5 shows the weapon stabilizer/hanger mounting bracket from the front with fasteners.

FIG. 5 shows the weapon stabilizer/hanger 2 mounting bracket 40 from the front 52 with fasteners 66. The mounting bracket 40 is secured to the tree 60 with fasteners 66, in this embodiment are screws 66. The fasteners 66 pass through the openings therethrough 68 securing the mounting bracket 40 securely to a tree 60. Also present are the hooks or stops 62.

Figure 6:
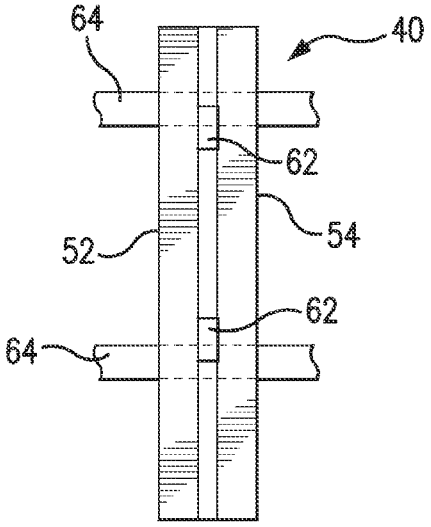
FIG. 6 shows the weapon stabilizer/hanger mounting bracket from the front with two straps for support.

FIG. 6 shows the weapon stabilizer/hanger 2 mounting bracket 40 from the front 52 with two straps 64 for support. The straps 64 are attached to the mounting bracket on its back 54. Here the straps 64 attached the mounting bracket 40 to the tree and secure it for the mounting of the stabilizer/hanger 2.

Figure 7:
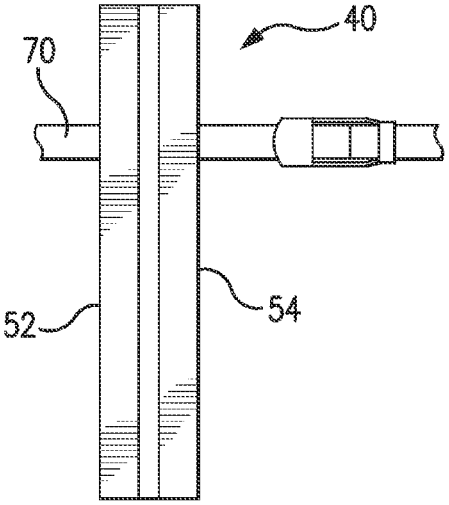
FIG. 7 shows the weapon stabilizer/hanger mounting bracket from the front with a ratchet strap.

FIG. 7 shows the weapon stabilizer/hanger 2 mounting bracket 40 from the front 52 with a ratchet strap 70. This embodiment allows the user to quickly attach the mounting bracket 40 to a tree or pole 60. Here the user can adjust height of the mounting bracket 40 quickly and easily.

Figure 8:
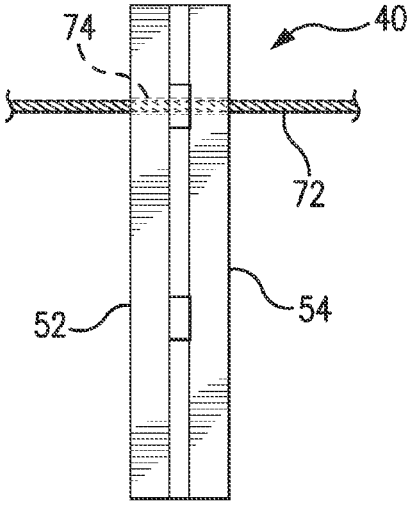
FIG. 8 shows the weapon stabilizer/hanger mounting bracket from the front secured by a rope.

FIG. 8 shows the weapon stabilizer/hanger 2 mounting bracket 40 from the front 52 secured by a rope 72. The mounting bracket 40 has an opening therethrough 74 that allows the rope 72 to pass through and then the rope 72 is used to secure the mounting bracket 40 to a tree 60.

Figure 9:
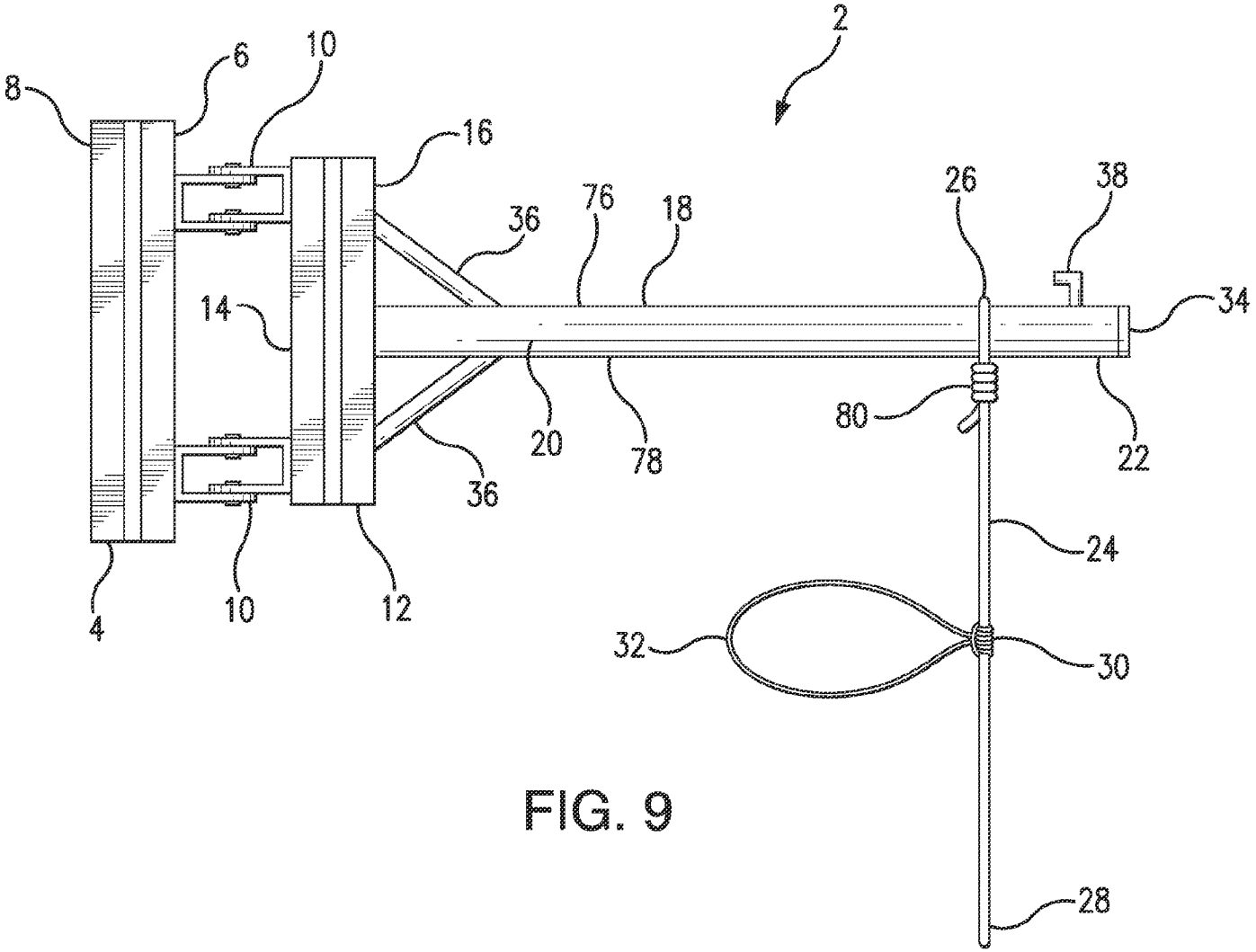
FIG. 9 shows another embodiment that includes support gussets, loop stop and end cap.

FIG. 9 shows another embodiment of the weapon stabilizer/hanger 2 that includes support gussets 36, loop stop 38 and end cap 34. The support bracket 4 has a front 6 and a back 8. The support bracket 4 is attached to the support bar 12 via the hinges 10. The support bar 12 has a back 14 and a front 14. The support arm 18 is attached to the support bar 12 front 16. The gussets 36 also connect from the support bar 12 front 16 to the support arm 18 top surface 76 and bottom surface 78 near the first end 20 of the support arm 18. The cord 24 depends from the support arm 18. The cord 24 has a first end 26 that has a slip knot 80 that loosely attaches the cord 24 to the support arm 18. Near the second end 28 of the cord 24 is a Prusik knot 30 that forms the loop 32.

The Prusik knot 30 is a knot that is used in mountaineering for tying a small sling to climbing rope as an aid to one who has fallen into a crevasse and that holds fast when weighted but is movable when unweighted. This is a critical feature to the weapon stabilizer/hanger 2 in that the Prusik knot holds the weapon and holds fast when the weight of the weapon is depending from it and then it is easily movable when the weapon has been removed. The loop 32 is a completely different cord 32 than the cord 24. This knot allows the user to adjust the positioning of the loop 32 to put the stabilized weapon in a correct location for sighting and firing the weapon keeping the weapon completely stable. It has been discovered that the use of the Prusik knot gives the weapon stabilizer/hanger 2 a greater utility over any other prior art device.

Figure 10:
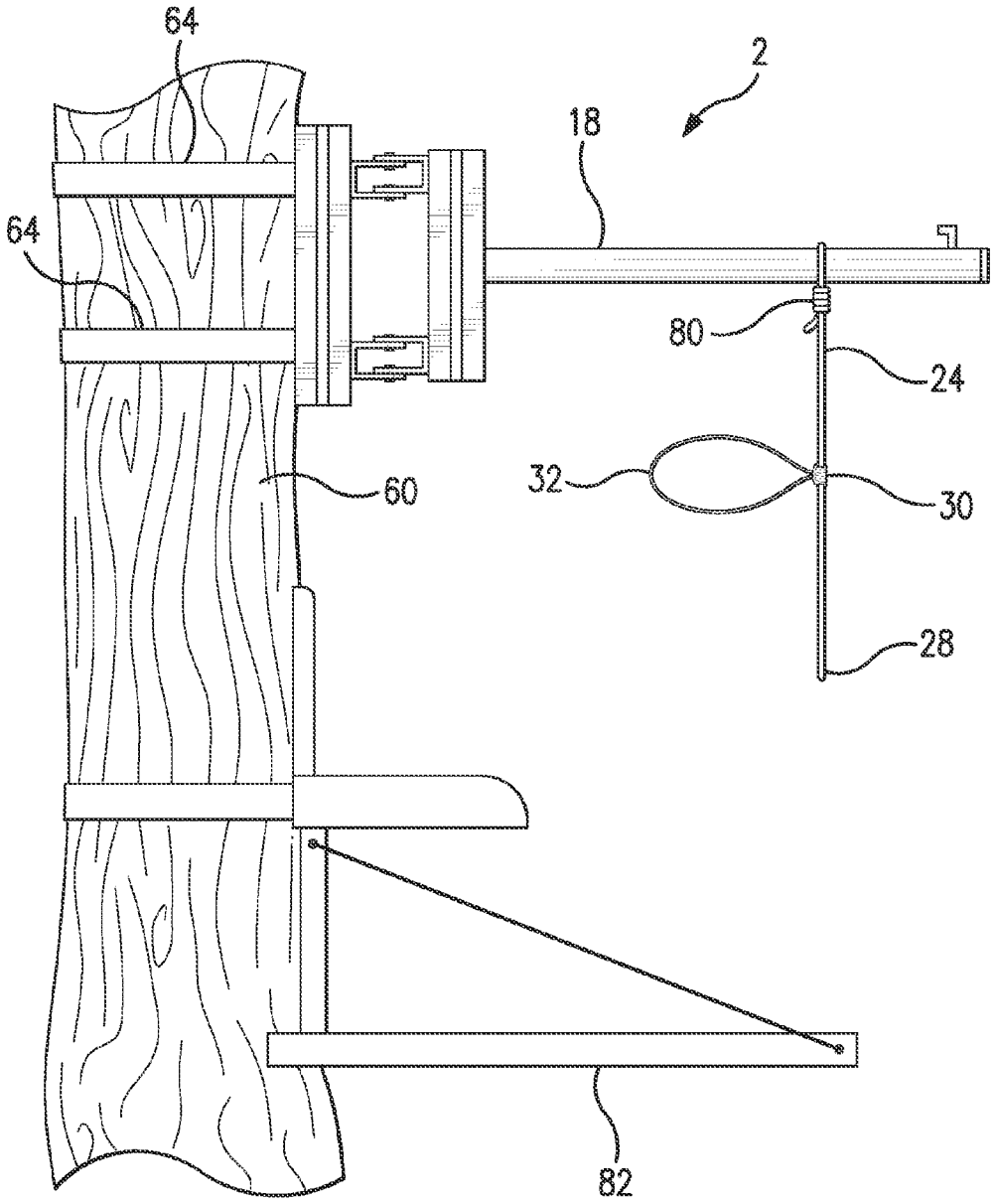
FIG. 10 shows the weapon stabilizer/hanger secured to a tree above a tree stand.

FIG. 10 shows the weapon stabilizer/hanger 2 secured to a tree 60 above a tree stand 82. The user simply places the loop 32 around scope of the weapon holding fast once the weight is applied. The support arm 18 swings freely allowing the user to swing the support arm 18 in 180°. This embodiment does not utilize the support bracket and is secured directly to the tree 60 via two straps.

Figure 11:
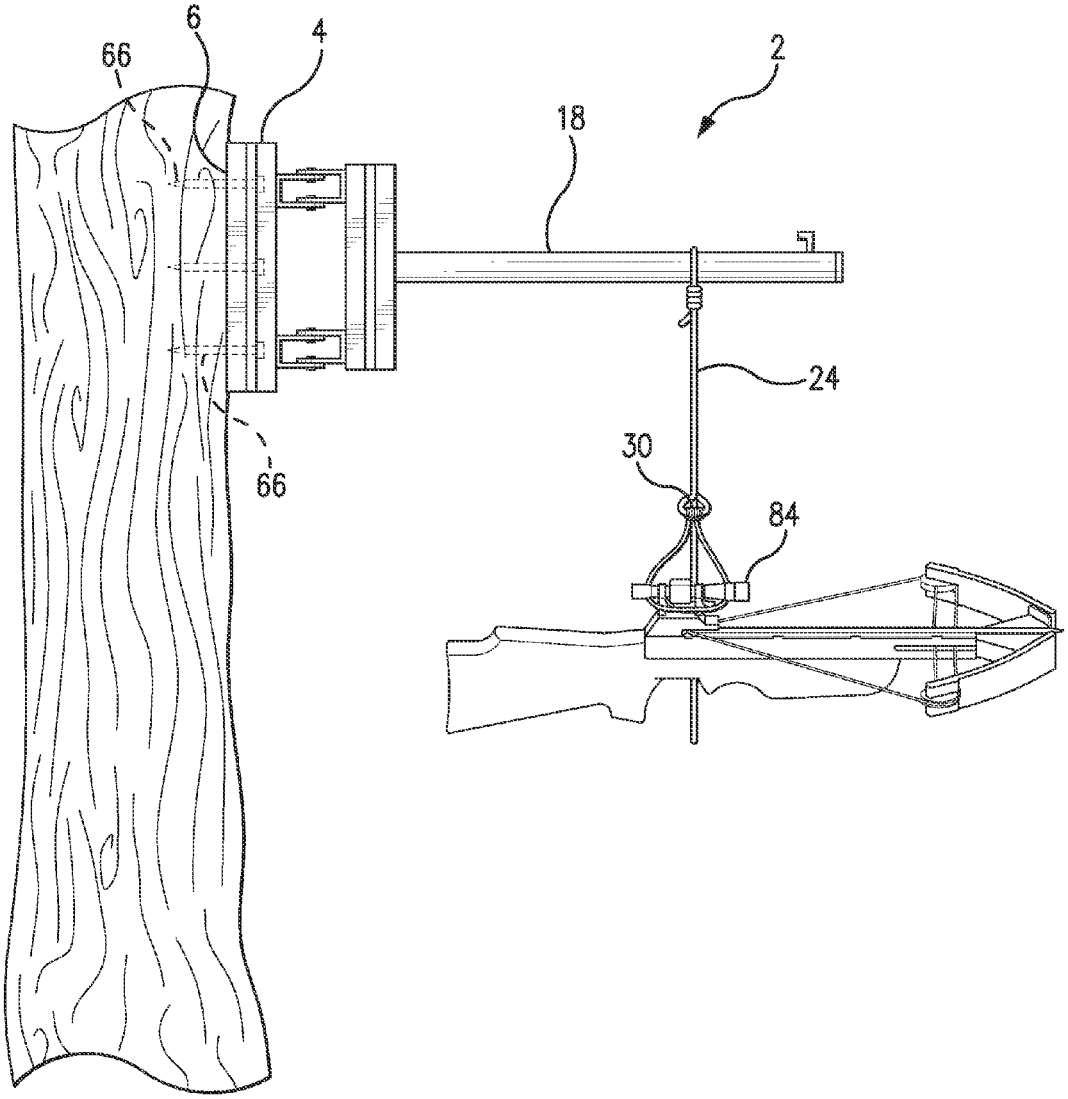
FIG. 11 shows the weapon stabilizer/hanger with a crossbow secure to it.

FIG. 11 shows the weapon stabilizer/hanger 2 with a crossbow secure to it. This embodiment uses the mounting bracket 40 which is lagged 64 to the tree 60. The lags 64 are shown in phantom. The cord 24 is loosely connected to the support arm 18. The cord 24 depends to and beyond the Prusik knot 30. The Prusik knot 30 forms the loop 32. The loop 32 encircles the scope 84 of the weapon and depends from the support arm 18 stabilized for shooting.

Figure 12:
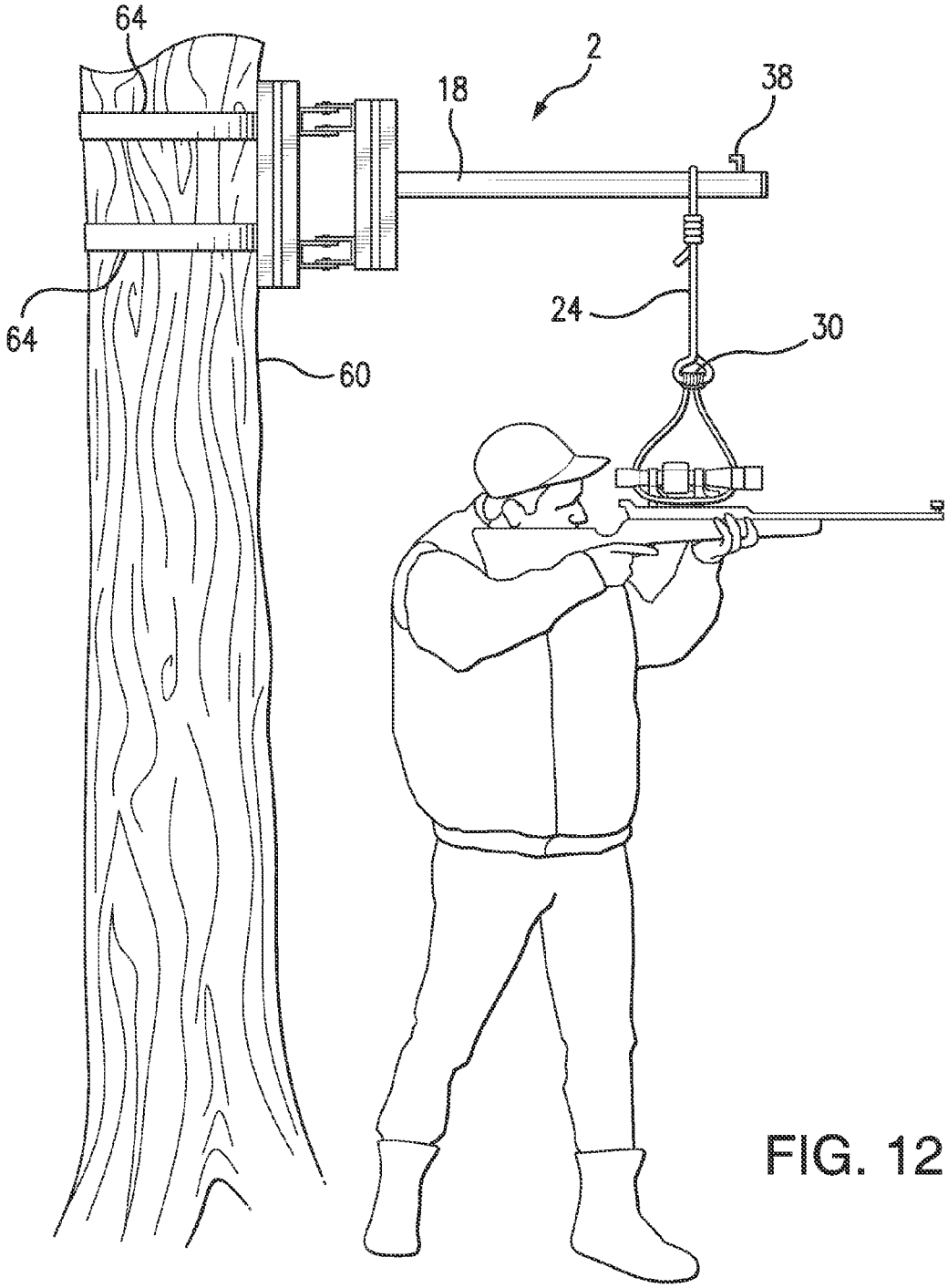
FIG. 12 shows the weapon stabilizer/hanger with a rifle secure to it.

FIG. 12 shows the weapon stabilizer/hanger 2 with a rifle secure to it. This embodiment does not use the mounting bracket 40. The stabilizer is once again secure to the tree 60 via straps 64. The support arm 18 has the cord depending from it near the cord stop 38. Once again the scope of the weapon encircles the scope 84 of the rifle and suspends it from the support arm 18 ready for use. The weapon is stabilized and can be readily adjusted by taking the weight from the Prusik knot 30.

Figure 13:
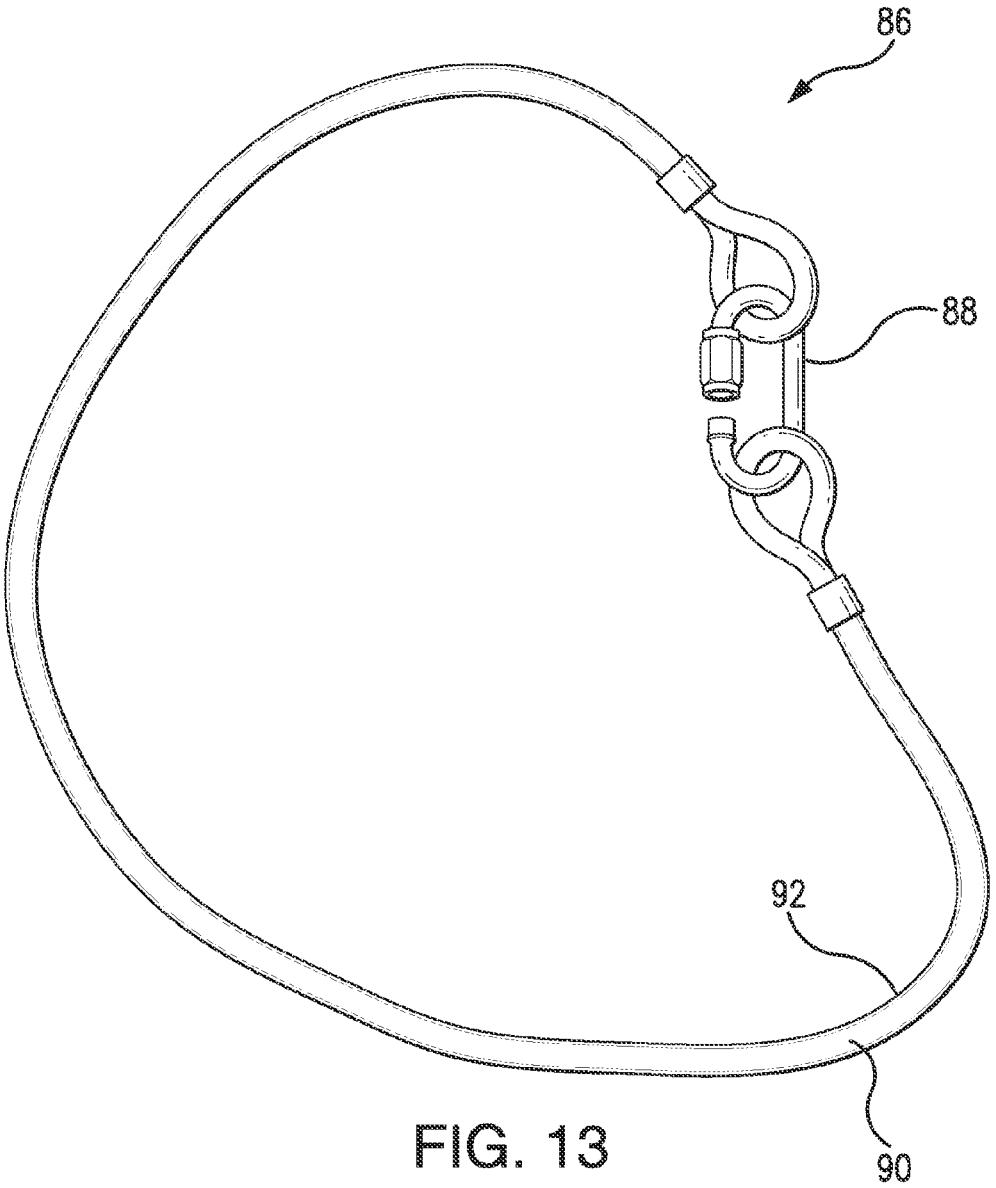
FIG. 13 shows the weapon stabilizer/hanger harness with a quick link attached to it.

FIG. 13 shows the weapon stabilizer/hanger 2 harness 86 with a quick link 88 attached to it. The harness 86 is constructed of a stainless steel cable or leader 90 that is protected by a shrink tubing 92. The harness is in addition to the Prusik knot 32 and loop 32. The quick connect 88 attaches to the loop 32 which is preset by the user so when they arrive at the hunting location the only need to attach the quick connect 88 to the loop 32. The harness 86 is also preset by the user to the weapon for quick connection and immediately available for use.

Figure 14:
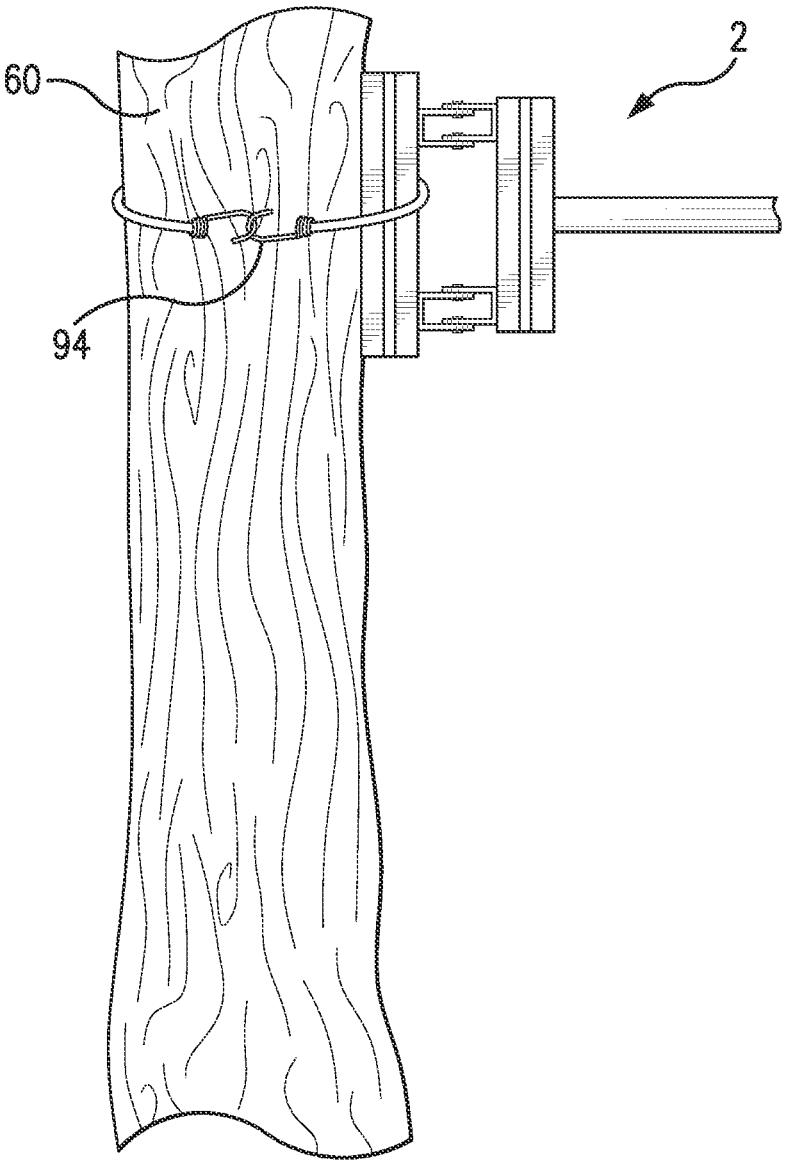
FIG. 14 shows the weapon/hanger attached to a tree with a bungee.

FIG. 14 shows the weapon stabilizer 2 attached to a tree 60 with a bungee. This is another embodiment where the mounting bracket 40 is not used and the weapon stabilizer is secured directly to the tree via a bungee 94.

Figure 15:
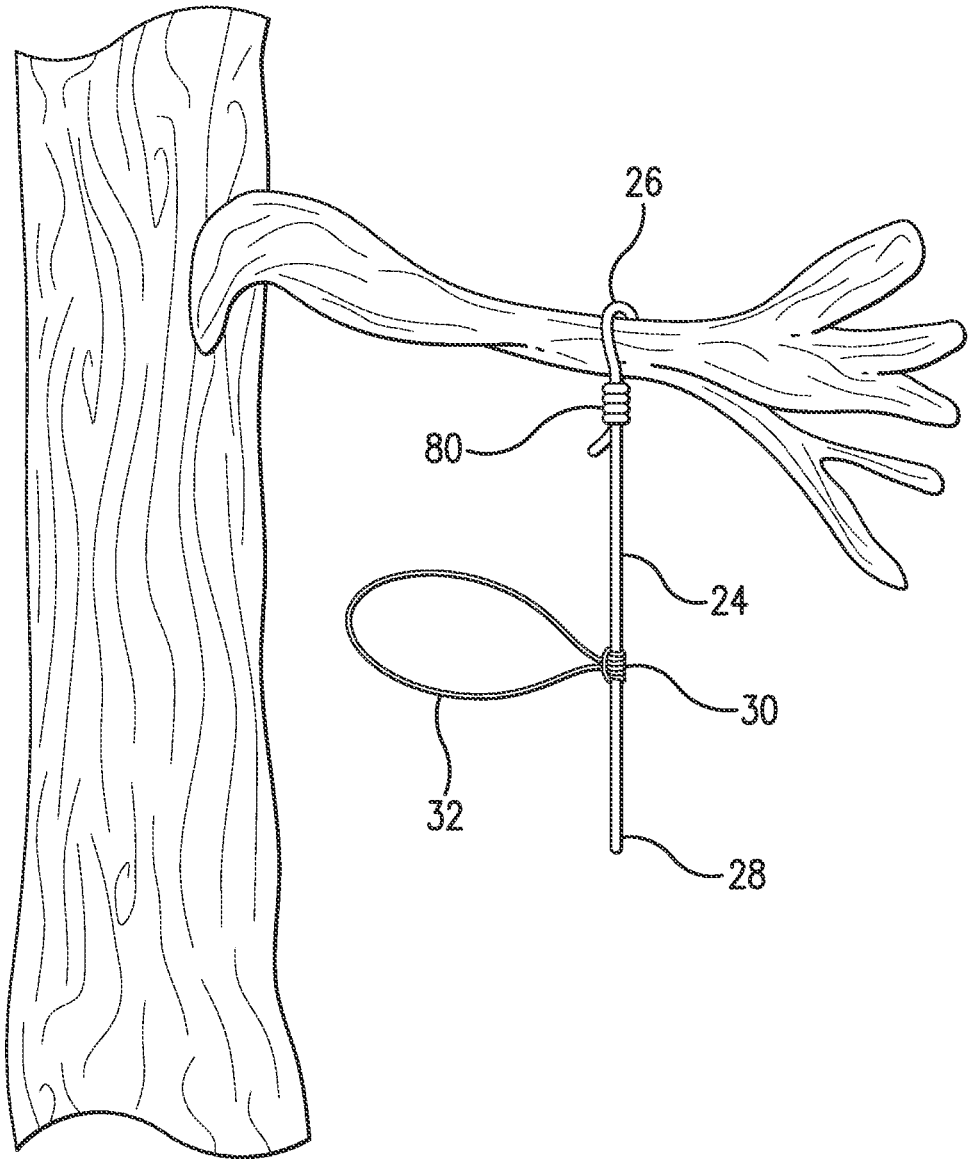
FIG. 15 shows the cord and the Prusik knot suspended from a branch.

FIG. 15 shows the cord 24 and the Prusik knot 30 suspended from a branch. The cord 24 depends from the branch. The cord 24 has a first end 26 that has a slip knot 80 that loosely attaches the cord 24 to the branch. Near the second end 28 of the cord 24 is a Prusik knot 30 that forms the loop 32. This embodiment allows the user to use the Prusik knot 30 portion of the device where natural obstructions prevent usage of the stabilizer arm 18 to suspend the Prusik Knot 30.

What is claimed is:

1. An weapon stabilizer/hanger comprising:

i. a support bracket having a front and a back;

ii. at least two attachments mounted on said front of said support bracket, each said attachment being articulatable in a horizontal plane;

iii. a support bar having a back and a front, said support bar being fixedly attached to each of the attachments at said back of said support bar, said attachments being spaced apart a predetermined distance from each other;

iv. a support arm having a first end and a second end, being fixedly attached to said front of said support bar by said first end;

v. one end of a cord being looped around said support arm, the opposite end of said cord having a Prusik knot tied thereon near the opposite end thereof, said opposite end of said cord having a fixed looped terminal end.

2. A weapon stabilizer/hanger as claimed in claim 1, wherein said stabilizer/hanger hangs from a mounting bracket.

3. A weapon stabilizer/hanger as claimed in claim 2, wherein said mounting bracket is secured with lags.

4. A weapon stabilizer/hanger as claimed in claim 2, wherein said mounting bracket is secured with a strap.

5. A weapon stabilizer/hanger as claimed in claim 2, wherein said mounting bracket is secured with rope.

6. A weapon stabilizer/hanger as claimed in claim 2, wherein said mounting bracket is secured fasteners.

7. A weapon stabilizer/hanger as claimed in claim 1, wherein said stabilizer/hanger is secured with lags.

8. A weapon stabilizer/hanger as claimed in claim 1, wherein said weapon stabilizer/hanger is secured with wire.

9. A weapon stabilizer/hanger as claimed in claim 1, wherein said weapon stabilizer/hanger is secured with a strap.

10. A weapon stabilizer/hanger as claimed in claim 1, wherein said weapon stabilizer/hanger is secured with rope.

11. A weapon stabilizer/hanger as claimed in claim 1, wherein said weapon stabilizer/hanger is secured by fasteners.

12. A weapon stabilizer/hanger as claimed in claim 1, wherein said cord loop secures to a harness.

13. A weapon stabilizer/hanger as claimed in claim 1, wherein said cord loop is secured to a scope.

14. A weapon stabilizer/hanger as claimed in claim 1, wherein said weapon stabilizer/hanger attaches to a harness.

15. A weapon stabilizer/hanger as claimed in claim 14, wherein said harness attaches to the weapon stabilizer/hanger with a quick link.

16. A weapon stabilizer/hanger as claimed in claim 1, wherein said mounting bracket is secure with a bungee strap.

* * * * *